US011109633B2

(12) United States Patent
Hoshizaki

(10) Patent No.: US 11,109,633 B2
(45) Date of Patent: Sep. 7, 2021

(54) HELMET

(71) Applicant: Thomas Blaine Hoshizaki, Rockcliffe Park (CA)

(72) Inventor: Thomas Blaine Hoshizaki, Rockcliffe Park (CA)

(73) Assignee: MIPS AB, Täby (SE)

( * ) Notice: Subject to any disclaimer, the term of this patent is extended or adjusted under 35 U.S.C. 154(b) by 296 days.

(21) Appl. No.: 16/074,219

(22) PCT Filed: Jan. 31, 2017

(86) PCT No.: PCT/CA2017/050109
§ 371 (c)(1),
(2) Date: Jul. 31, 2018

(87) PCT Pub. No.: WO2017/132758
PCT Pub. Date: Aug. 10, 2017

(65) Prior Publication Data

US 2019/0328072 A1 Oct. 31, 2019

Related U.S. Application Data

(60) Provisional application No. 62/290,251, filed on Feb. 2, 2016.

(51) Int. Cl.
*A42B 3/12* (2006.01)
*A42B 3/06* (2006.01)

(52) U.S. Cl.
CPC ..... *A42B 3/121* (2013.01); *A42B 3/062* (2013.01)

(58) Field of Classification Search
CPC ..... A42B 3/062; A42B 3/064; A42B 3/121; A42B 3/124; A42B 3/06; A42B 3/10;
(Continued)

(56) References Cited

U.S. PATENT DOCUMENTS 7,367,898 B2 5/2008 Hawkins et al.
7,461,726 B2 12/2008 Hawkins et al.
(Continued)

FOREIGN PATENT DOCUMENTS

CA 2 829 631 A1 4/2015
CA 2829631 * 4/2015 ..... A42B 3/04
(Continued)

OTHER PUBLICATIONS

International Search Report for corresponding International Application No. PCT/CA2017/050109 dated Mar. 21, 2017.
(Continued)

*Primary Examiner* — Katherine M Moran
(74) *Attorney, Agent, or Firm* — Pearne & Gordon LLP

(57) ABSTRACT

The present invention relates to a helmet comprising a shell; and a force redirection member disposed between the shell and a head when the helmet is worn, the member configured to redirect a force impacting on the shell to a direction different from the original direction of the impact on the shell. The present invention also relates to a method to decrease the risk of injury to a person wearing a helmet, caused by rotational forces when the helmet is impacted by a force characterized by a specific direction having a first vector, the method comprising redirecting the force into a different direction having a second vector, wherein the direction of the second vector is selected to reduce the risk of a specified injury associated with acceleration of the head in the direction of the first vector.

16 Claims, 26 Drawing Sheets

(58) Field of Classification Search
CPC .. A42B 3/12; A63B 71/10; F41H 1/04; F41H 1/06; F41H 1/08
USPC ..... 2/413, 425
See application file for complete search history.

(56) References Cited

U.S. PATENT DOCUMENTS

| | | | | |
|---|---|---|---|---|
| 7,676,854 | B2 | 3/2010 | Berger et al. | |
| 7,708,653 | B2 | 5/2010 | Hawkins et al. | |
| 8,800,978 | B2 | 8/2014 | Tarazona De La Asuncion | |
| 8,850,623 | B1 * | 10/2014 | Mazzoccoli | A42B 3/121 2/413 |
| 8,931,606 | B2 | 1/2015 | Hawkins et al. | |
| 9,089,180 | B2 | 7/2015 | Phipps et al. | |
| 9,095,179 | B2 * | 8/2015 | Kwan | A42B 3/121 |
| 9,220,310 | B2 | 12/2015 | Hawkins et al. | |
| 9,289,021 | B2 | 3/2016 | Kwan et al. | |
| 9,388,873 | B1 | 7/2016 | Phipps et al. | |
| 9,439,469 | B2 | 9/2016 | Phipps et al. | |
| 9,549,582 | B2 | 1/2017 | Phipps et al. | |
| 10,306,941 | B2 * | 6/2019 | Durocher | A42B 3/12 |
| 2006/0191403 | A1 | 8/2006 | Hawkins et al. | |
| 2007/0068775 | A1 | 3/2007 | Vermeulen et al. | |
| 2008/0268978 | A1 | 10/2008 | Hawkins et al. | |
| 2008/0307568 | A1 | 12/2008 | Sajic | |
| 2010/0083424 | A1 | 4/2010 | Linares | |
| 2010/0264571 | A1 | 10/2010 | Tarazona De La Asuncion | |
| 2010/0313745 | A1 | 12/2010 | Hawkins et al. | |
| 2012/0060251 | A1 | 3/2012 | Schimpf | |
| 2012/0139172 | A1 | 6/2012 | Hawkins et al. | |
| 2013/0061371 | A1 | 5/2013 | Phipps et al. | |
| 2013/0185837 | A1 | 7/2013 | Phipps et al. | |
| 2014/0097052 | A1 * | 4/2014 | Reynolds | F16F 1/376 188/377 |
| 2014/0109299 | A1 | 4/2014 | Kwan et al. | |
| 2014/0173810 | A1 | 6/2014 | Suddaby | |
| 2015/0164172 | A1 | 6/2015 | Linares | |
| 2015/0250246 | A1 | 9/2015 | Phipps et al. | |
| 2015/0305424 | A1 | 10/2015 | Kwan et al. | |
| 2016/0270469 | A1 | 9/2016 | Kwan et al. | |
| 2016/0369861 | A1 | 12/2016 | Phipps et al. | |
| 2017/0020223 | A1 * | 1/2017 | Abbondanza | A42B 3/20 |
| 2019/0167095 | A1 * | 6/2019 | Krueger | A61B 3/145 |

FOREIGN PATENT DOCUMENTS

| | | | |
|---|---|---|---|
| CN | 1997506 | B | 6/2012 |
| WO | 2011/139224 | A1 | 11/2011 |

OTHER PUBLICATIONS

Written Opinion for corresponding International Application No. PCT/CA2017/050109 dated Mar. 21, 2017.
Chinese Office Action for corresponding Chinese Application No. 2017800096487 dated Aug. 31, 2020 and English translation.
Extended European Search Report for corresponding European Application No. 17746668.7 dated Oct. 23, 2019.

* cited by examiner

HELMET

CROSS-REFERENCE TO RELATED APPLICATION

This application claims priority to U.S. Provisional application No. 62/290,251 μfiled Feb. 2, 2016, which is hereby incorporated by reference in its entirety.

FIELD

The present invention relates to helmets for protecting a head from an impact and method of reducing a head injury caused by the impact.

BACKGROUND

The primary purpose of a helmet is to protect the user's head and brain from injury. Helmets typically include a hard outer shell and energy absorbing liner or inner layer. The outer shell is designed to distribute the load of the force in order to engage a greater volume of the energy absorbing liner. The energy absorbing liner usually comprises a compliant material that absorbs impact energy by distorting and absorbing the impact using the resilient and/or compressible properties of the material or by crushing and absorbing energy by material fracture.

Head injuries typically result from linear and/or rotational forces acting on the head. Certain types of head injuries such as skull fractures and intracranial bleeds are usually associated with linear accelerations. Injuries such as concussions and subdural hematomas are thought to be more closely associated with angular accelerations. Conventional helmets are primarily designed to manage linear forces and are less effective at managing shear or rotational forces. This has resulted in successful mitigation of injuries associated with linear forces such as skull fractures and intracranial hemorrhaging, but less success in reducing injuries such as concussions that are more closely associated with rotational or shear forces.

Solutions intended to manage rotational motions have been developed and proposed, such as providing a slippery surface material to cover the helmet thereby decreasing the friction between the surface of the helmet and the impacting object. Other solutions include a suspension system employing low friction materials between the head and the helmet, or providing a compartment that consists of a gel, liquid or other soft material between the shell and liner, or other layers of materials, to allow the outer shell to rotate and/or slide horizontally independent of the liner or the user's head. However, conventional solutions of these types may not be sufficient to prevent brain injury in the case of impacts from certain directions, such as an impact that is directly perpendicular to the surface of the helmet at the point of impact—in such cases, the force of the impact would be transmitted to the head without any change in direction of the force.

While linear and rotational forces usually occur together, the magnitude and direction of each force is dependent on the amount of energy, location, and direction of the impact in relation to the geometry of the head. The direction of the linear and rotational accelerations of the head creates forces on the brain tissue can result in brain injuries that include concussion, sub-dural, and intracranial bleeds. The direction of the forces and the resultant acceleration associated with injury is specific to the location of the impact on the head.

Human heads are irregular in shape. For reference, the head can be divided using a series of anatomical planes that intersect at a common point. Shown in FIGS. 1*a* and 1*b* are schematic depictions of the frontal, sagittal, and horizontal planes of the human head. The frontal plane is defined as the vertical plane that extends laterally between the left and right sides (parietal) of the head. The sagittal plane is defined as the vertical plane that extends longitudinally from the front the head (forehead) to the back of the head (occipital). The horizontal plane is defined as being the plane perpendicular to the vertical axis of the head. The three axes are defined as the vertical axis V, a transverse axis T and a longitudinal axis L, wherein the respective axes intersect at the same point of intersection of the respective planes.

The human brain is a complex organ made up of a variety individual structures including the cerebral cortex, cerebellum, corpus callosum, thalamus, brain stem, white matter, grey matter, vascular system, connective tissue and cerebral spinal fluid. The individual structures contribute to complex and interactive brain functions. These structures create an uneven distribution of material that varies the vulnerability of the brain to injury. The direction and magnitude of forces on the brain tissue may lead to different levels of risk of injury for particular parts of the brain. For this reason, the brain is sensitive to the direction of the applied acceleration. It is an advantage to effectively manage the accelerations that are known to create high level of brain injury. An example of this is the vulnerability of the brain to concussive injuries seen during the acceleration in the frontal plane and the vulnerability of the brain to subdural hematoma seen during acceleration in the sagittal plane.

Shown in FIGS. 2*a* and 2*b* are dynamic response curves describing the linear and rotational acceleration, respectively, of a head (modeled using a hybrid III headform) after an impact to the front left boss (temple) of the head. The x, y, and z components reflect the linear or angular accelerations in specific directions, as follows:

x) The x component represents acceleration along the frontal plane of the head. This movement results from a lateral impact to the head and tends to cause transverse (lateral) movement and/or rotation about longitudinal axis L.

y) They component represents acceleration along the sagittal plane of the head. This movement results from an impact to the front or rear of the head and results in longitudinal movement and/or rotation about transverse axis T.

z) The z component represents acceleration along the horizontal plane of the head. This movement results from a horizontal impact to the head and tends to cause rotation about the vertical axis V.

As shown from these graphs, the dynamic response of the head is a function of the specific location where the impact occurs, the direction of the force, and the geometry and overall shape of the head at that particular location. As shown, the duration of an impact event may span a relatively period of about 4 milliseconds. To some extent, different injuries to the head are a function of the location and direction of the impact relative to the head. There is a greater risk of subdural haematoma if a high rotational acceleration is experienced about the axis T. A higher risk for concussion arises if a rotational acceleration is experienced about the axis L. The proportion of the acceleration (i.e. the component) that occurs in each plane (frontal, sagittal, or horizontal) is dependent on the location and direction of the impact. When an impact force having a magnitude and a direction is applied to the shell, the head will experience linear acceleration in a direction in line with the direction of the incoming force. The head will also experience rotational acceleration about one or more of the axes L, T, and V, where the proportion of the acceleration in each plane will be dependent on the location and direction of the impact.

Shown in FIGS. 3*a-c* is a force impacting a conventional helmet (made from an outer shell and foam insert) and the resultant linear and rotation acceleration experienced by a head wearing the conventional helmet. In FIGS. 3*a-b*, the force is shown impacting the conventional helmet at the side of the head which then causes the head to accelerate linearly in a plane parallel to the frontal plane and to rotate along the frontal plane and about the axis L. In FIG. 3*c*, the head in FIGS. 3*a-b* is omitted to more clearly illustrate the linear and rotational forces that are generated from the impact to the side of the head by the force. In FIGS. 3*a-c*, the force of the impact results in the rotational acceleration of the head about the axis L which will result in a higher risk for concussion.

SUMMARY

In one aspect, we disclose a helmet that could decrease the risk of injuries such as concussion and subdural hematoma by independently managing the forces that are associated with injury at each location of the head. The helmet and components thereof may reduce the risk of injury in response to the magnitude, direction, location and/or duration of the impact. Since each location of the head has specific response characteristics that require unique characteristics of the protective device designed for that particular location, in order to better manage the interacting forces, especially the rotational forces resulting from an impact to the head, to the helmet discriminates between impacts depending on their locations on the head and direction of force, especially the rotational forces. Increased effectiveness of managing acceleration of the head in one or more directions is expected to decrease the risk for certain specific injuries.

In one aspect, we disclose a helmet having more or more force redirection members located between the shell and the user's head which redirect an impact force to decrease the risk of certain head injuries. The force redirection members are configured to redirect an impact that strikes the helmet shell such that the head is subjected to a different direction of force relative to the direction of the impact. In some aspects, the redirection of the forces is achieved by various means, including use of specific materials, configuration, geometry and positioning of the force redirection members on the helmet.

In one aspect, we disclose a helmet comprising:

a shell; and a force redirection member disposed between the shell and a head when the helmet is worn, the member configured to redirect a force impacting on the shell to a direction different from the original direction of the impact on the shell.

According to an aspect, the force redirection member comprises a body having an incident surface which is disposed at an acute angle relative to the tangent of the surface of the helmet overlying the force redirection member.

According to an aspect, the body comprises a wedge.

According to an aspect, the body comprises a composite structure of a first material having a first property and a second material different from the first material.

According to an aspect, the first and second materials are different in any one of resilience, compressibility, and stiffness.

According to an aspect, the member is substantially symmetrical about two orthogonal planes of symmetry.

According to an aspect, the helmet comprising a plurality of the force redirection members distributed at a plurality of locations around the helmet.

According to an aspect, the plurality of the force redirection members are distributed along a region of the helmet that is substantially aligned with a sagittal plane of the head when the helmet is worn.

According to an aspect, the force redirection members redirect the force so that the resultant force comprises a first directional vector component that is parallel to a horizontal plane and a second directional vector component that is parallel to a frontal plane of the head when the helmet is worn.

According to an aspect, the plurality of force redirection members are distributed along a region of the helmet that is substantially aligned with a frontal plane of the head when the helmet is worn.

According to an aspect, the force redirection member redirects the force so that the resultant force comprises a first directional vector component that is parallel to a horizontal plane and a second directional component that is parallel to a sagittal plane of the head when the helmet is worn.

According to an aspect, the force redirection member is disposed between the shell and a helmet liner.

According to an aspect, the force redirection member is retained within a fluid-filled bladder.

According to an aspect, the force redirection member comprises a compressible member that provides a fulcrum between the shell and the user's head, whereby an impact on the shell rotates the shell relative to the head about the fulcrum whilst compressing at least a portion of the force redirection member for attenuating the rotational force of the shell.

According to an aspect, the helmet further comprising a shear control spacer, the shear control spacer configured to resist compression of the spacer along at least one portion of the shear control spacer.

According to an aspect, the shear control spacer comprises a belt for resisting compression along the at least one portion of the shear control spacer.

According to an aspect, the helmet further comprising a plurality of force redirection members distributed at a plurality of locations around the helmet.

According to an aspect, at least a portion of the force redirection members are distributed along a region of the helmet that is substantially aligned with a sagittal plane of the head when the helmet is worn, and wherein these members comprise direction members that resist compression in the sagittal plane.

According to an aspect, at least a portion of the force redirection members are distributed along a region of the helmet that is substantially aligned with a frontal plane of the head when the helmet is worn, and wherein these members comprise direction members that resist compression in the frontal plane.

According to an aspect, the helmet further comprising a force redirection member secured within the spacer, the member configured to receive the force and redirect the force towards a different direction when the helmet is impacted.

According to an aspect, the contour of the bladder is shaped so as to conform to the shape of the force redirection member.

In one aspect, we disclose a force redirection member for use with a helmet, the helmet comprising a shell the member configured to redirect a force impacting on the shell to a direction different from the original direction of the impact on the shell.

In one aspect, we disclose a force redirection member for use with a helmet, the helmet comprising a shell for receiving a force having a magnitude and direction, the member configured to redirect a force impacting on the shell to a direction different from the original direction of the impact on the shell.

In one aspect, we disclose a method to decrease the risk of injury to a person wearing a helmet, caused by rotational forces when the helmet is impacted by a force characterized by a specific direction having a first vector, the method comprising redirecting the force into a different direction having a second vector, wherein the direction of the second vector is selected to reduce the risk of a specified injury associated with acceleration of the head in the direction of the first vector.

According to an aspect, the method further comprising the steps of:

securing a force redirection member to the interior of a helmet for receiving the force, the member having at least one outward facing incident surface configured to receive the force transmitted through the helmet; and positioning the force redirection member so that the force will meet the incident surface to form an angle therewith that is different from the angle normal to the incident surface to change the directional vector of the force so that the second vector comprises at least one vector component that is different from that of the first vector.

According to an aspect, the force redirection member is secured along a region of the interior of the helmet that is substantially aligned with a sagittal plane of the head when the helmet is worn and wherein the at least one vector component is parallel to a horizontal plane.

According to an aspect, the force redirection member is secured along a region of the interior of the helmet that is substantially aligned with a frontal plane of the head when the helmet is worn and wherein the at least one vector component is parallel to a horizontal plane.

Unless otherwise specified, directional references herein refer to the helmet and head in an upright position. Furthermore, the detailed description herein is only intended to provide examples and representative embodiments of the invention and is not intended to limit the scope of the invention. The full scope of the invention is presented in the specification as a whole.

DETAILED DESCRIPTION

Figure 4A:
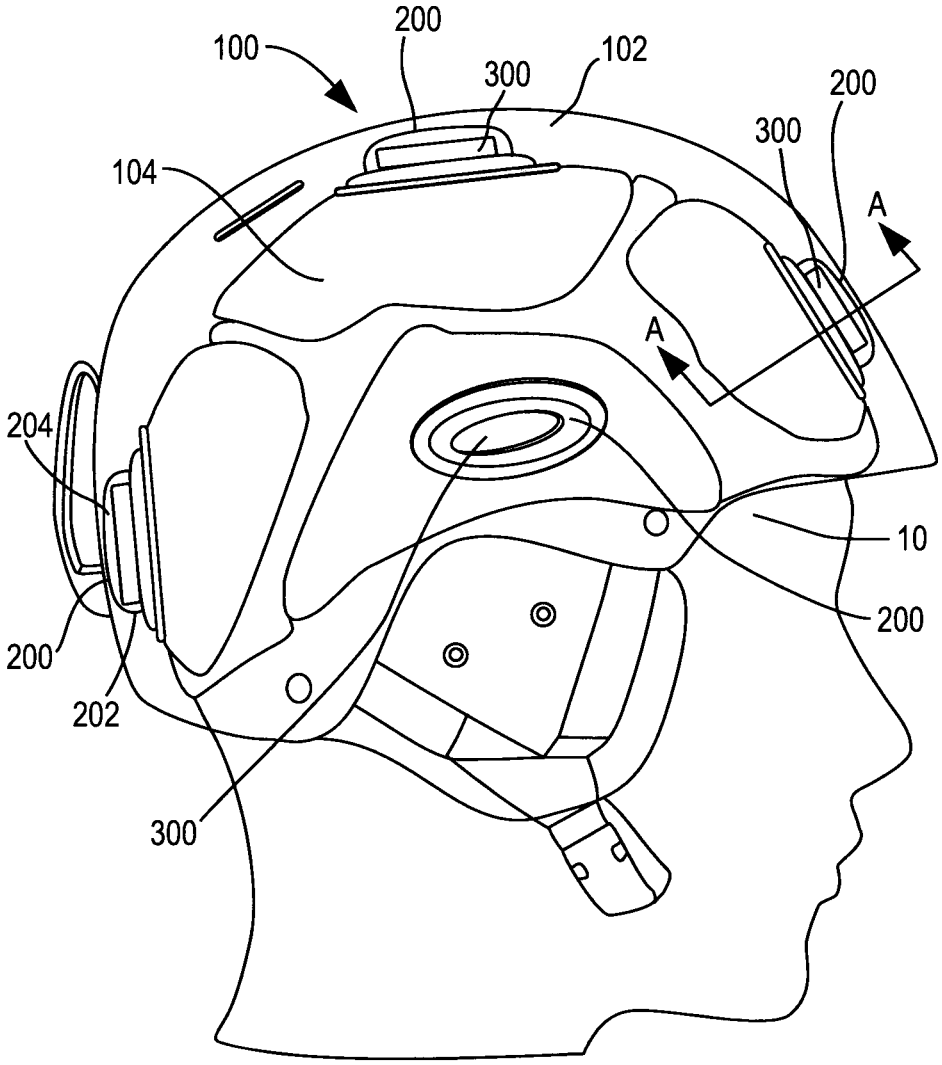
FIG. 4*a* is a side elevation view of a first embodiment of a helmet according to the invention, shown a partially transparent view to show internal structure.
Figure 4B:
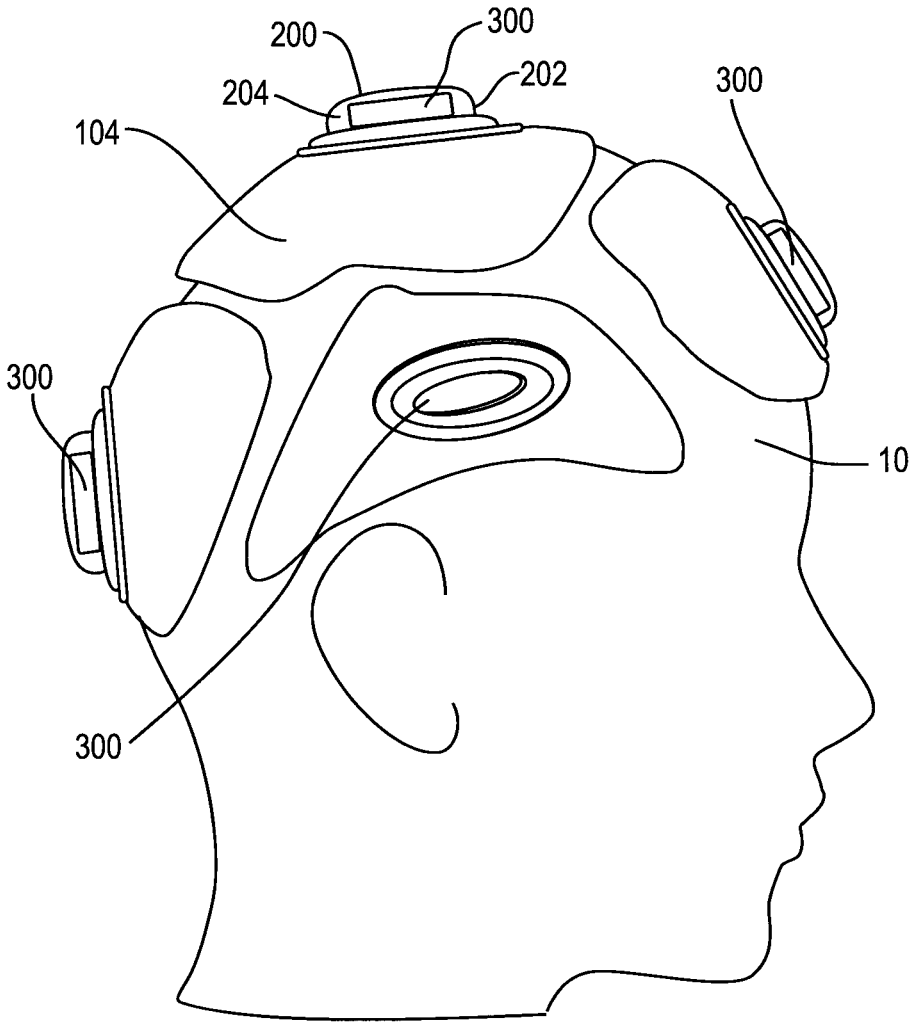
FIG. 4*b* is a side elevation view of the first embodiment, in which the outer shell has been removed.

Shown in FIG. 4*a* is a helmet 100 for protecting a head 10 of a wearer. Helmet 100 may be configured for essentially any activity in which a wearer may be subject to a severe impact. Without limiting the generality of the invention, examples include contact sports such as football and hockey, bicycling, motorcycling and other motor sports, climbing, equestrian, snow sports and work helmets. Helmet 100 includes an outer shell 102 which is configured for the intended use. Outer shell 102 is normally (but not necessarily) relatively rigid and may comprise polycarbonate, polyethylene or other suitable material. The selected material and its thickness and other parameters will depend on the functional requirements of the intended use. For example, a snowsports helmet may comprise a relatively thick and rigid fiberglass or carbon fiber layer, while a cycling helmet may comprise a thin, relatively flexible outer shell.

Interiorly disposed within shell 102 is an inner layer or liner 104 which normally makes contact with the user's head 10. Liner 104 may be a compressible material such as vinyl nitrile or polystyrene (EPS) or polypropylene (EPP) foam, or other structure/material able to absorb energy. Liner 104 may substantially line the entire interior surface of shell 102 or alternatively may have windows or other gaps in the structure.

Liner 104 is spaced from the interior surface of shell 102 by at least one spacer 200. As will be described in more detail below, spacer 200 permits independent rotational movement of shell 102 which is decoupled from liner 104. Spacer 200 can also redirect forces impacting the helmet from certain directions and can also attenuate linear and angular forces transmitted into the interior towards head 10 of a wearer.

A first embodiment of spacer 200 shown in FIGS. 4*a* through 5*b*. Spacer 200 comprises a bladder 202 which is filled with a fluid 204. Bladder 202 is relatively flexible and can be made from a material such as thermoplastic urethane (TPU) or polyvinyl chloride (PVC). Spacer 200 is configured to stretch or distort with the movement of fluid 204 upon the application of a force. When the force is removed, spacer 200 returns to its original shape. Fluid 204 has a low viscosity such as low viscosity oil or gel, or an aqueous fluid.

Figure 5A:
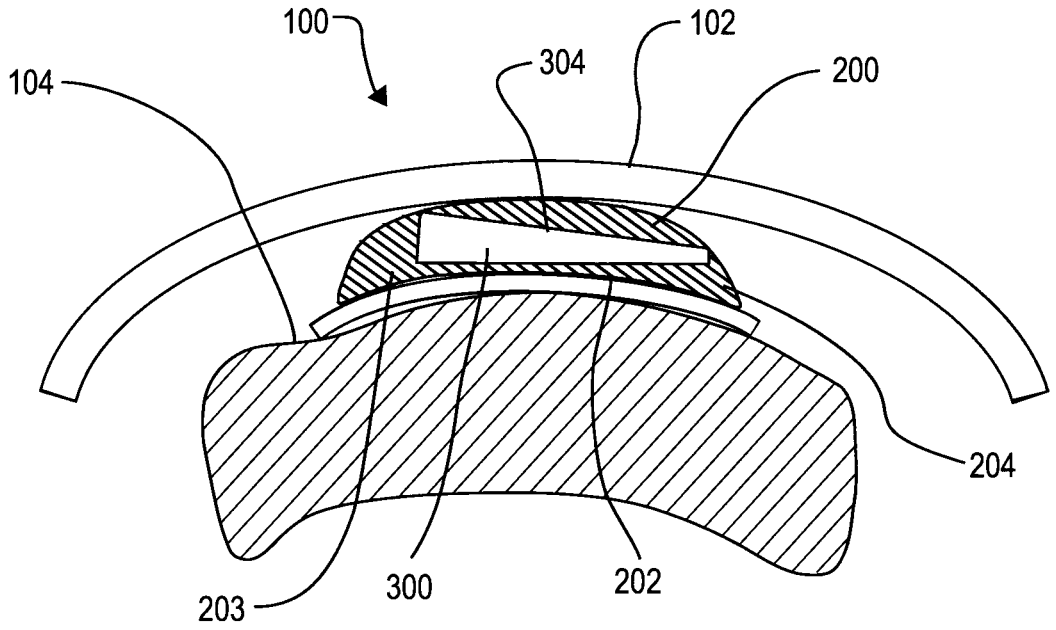
FIG. 5*a* is a cross sectional view along the line A-A of FIG. 4*a* showing a force redirection member of the helmet before impact with a force.
Figure 5B:
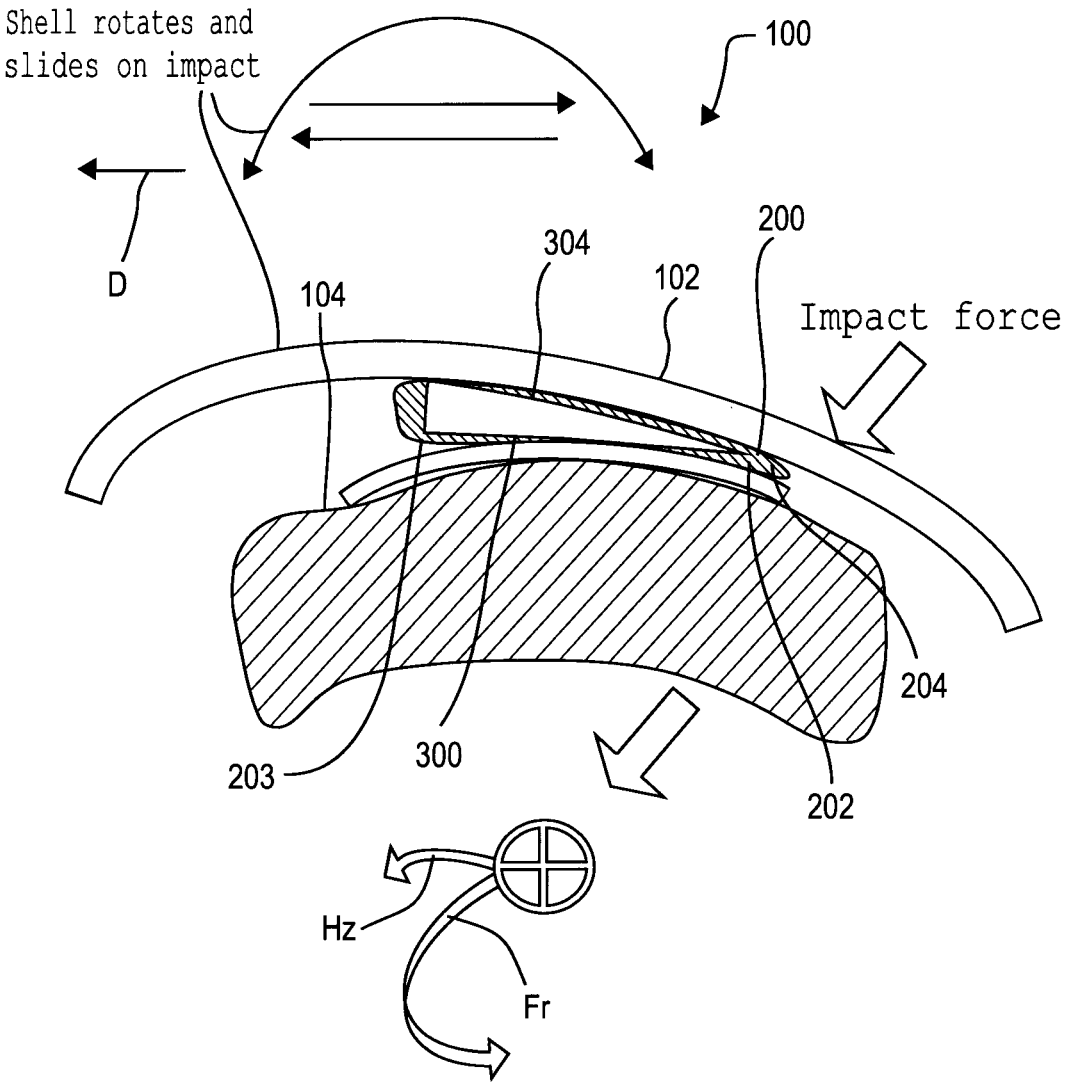
FIG. 5*b* is a cross sectional view along the line A-A in the helmet of FIG. 4*a* showing the force redirection member after impact with a force.

A force redirection member 300 is retained within bladder 202. With reference to FIGS. 5*a* and 5*b*, member 300 is configured to redirect an impact force (F) applied to outer shell 102 adjacent to spacer 200. The redirection causes outer shell 102 to rotate independently of liner 104 and/or to attenuate rotation of shell 102, and/or to cause liner 104 to rotate in a different direction from shell 102.

An impact to shell 102 (indicated by the arrow labelled "Impact" in FIG. 5*b*) which is directly adjacent to spacer 200, will compress the side of spacer 200 which is closest to the impact. In one aspect, force redirection member 300 may effectively act as a fulcrum which thus rotates shell 102 relative to liner 104, as seen in FIG. 5*b*, whereby rotation of liner 104 is redirected relative to shell 102. The compressible and resilient properties of member 300 also serve to attenuate rotational force by lengthening the duration of the force acting on liner 104 (for example, from about 4 ms in a conventional helmet to about 25 ms or longer), effectively decelerating the rotation of liner 104. The liquid filling within bladder 104 enhances this attenuation effect, while also decoupling rotational movement of shell 102 from liner 104.

Since bladder 202 is relatively flexible and is filled with fluid 204, spacer 200 acts as a slip plane between the layers secured above and below it. Consequently, shell 102 and/or liner 104 are freely displaced (rotate and/or slide) relative to each other when impacted, as shown schematically in FIG. 5*b*.

Figure 1A:
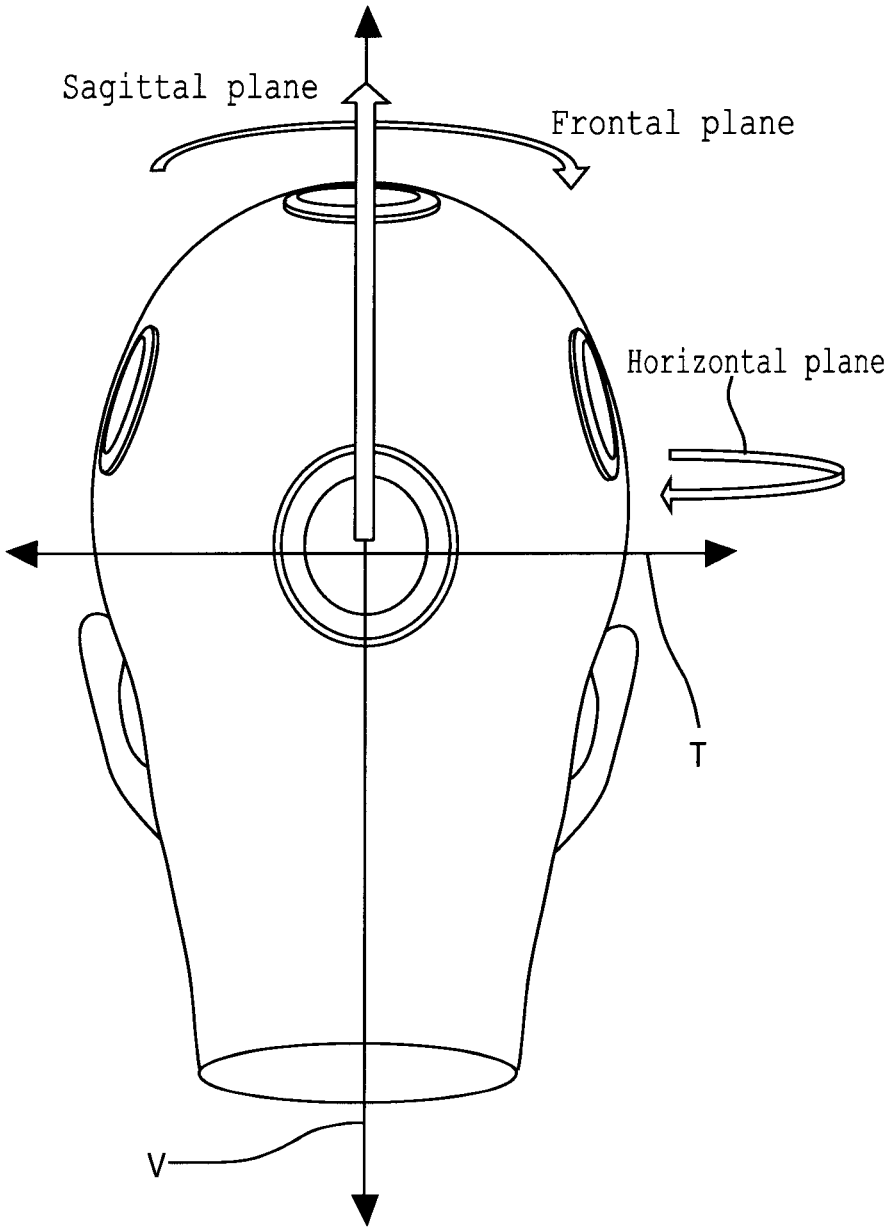
FIG. 1*a* is a rear elevation view of a human head illustrating sagittal, frontal, and horizontal anatomical planes.
Figure 1B:
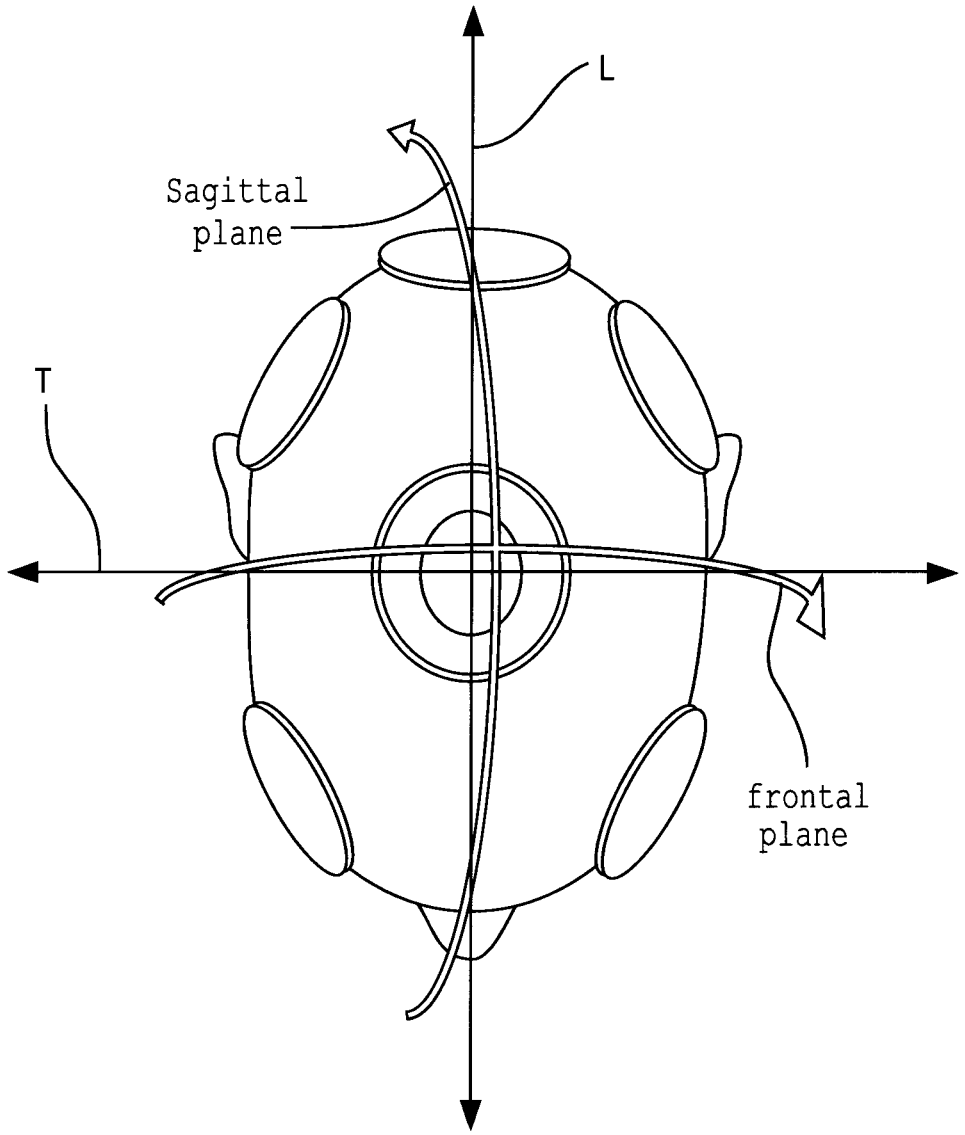
FIG. 1*b* is a top plan view of the head in FIG. 1*a* illustrating the sagittal and frontal anatomical planes.
Figure 2A:
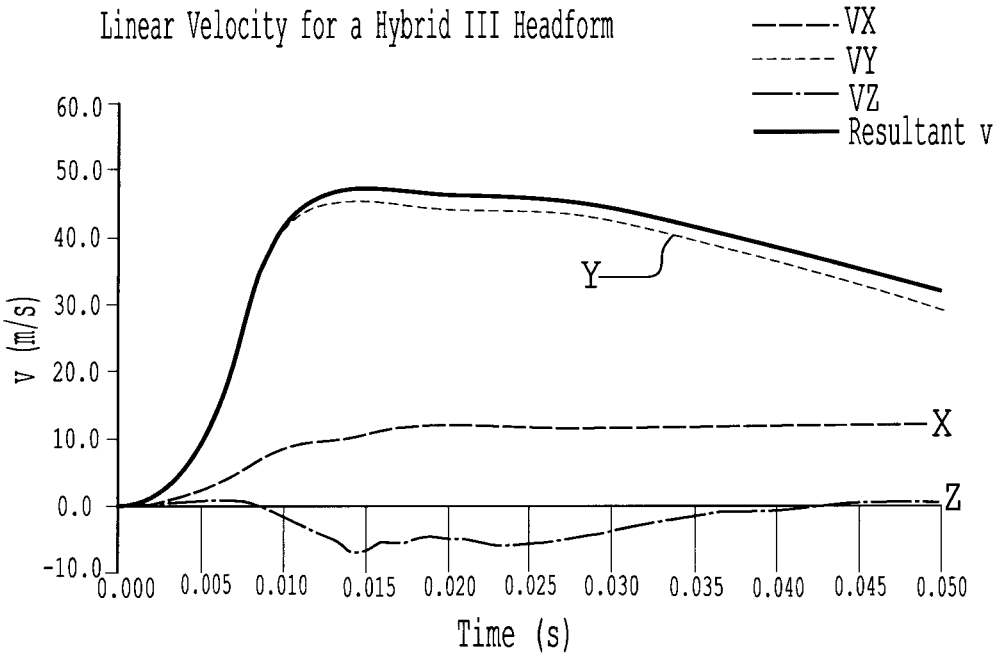
FIG. 2*a* is a dynamic response curve showing the linear acceleration experienced by a human head as a result of impact to the front left boss (temple) of the head.
Figure 2B:
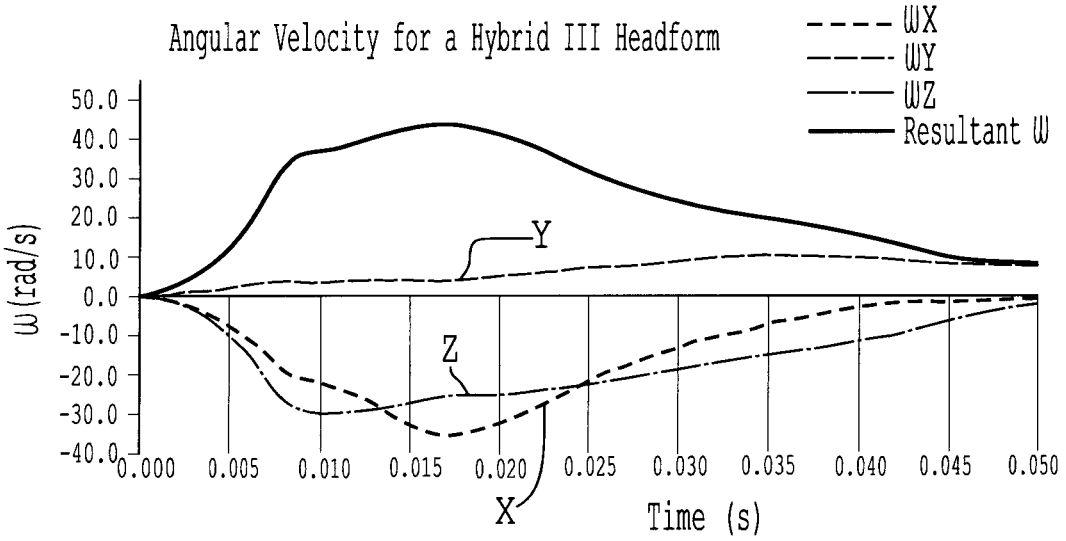
FIG. 2*b* is a dynamic response curve showing the angular acceleration experienced by a human head as a result of impact to the front left boss of the head.
Figure 3A:
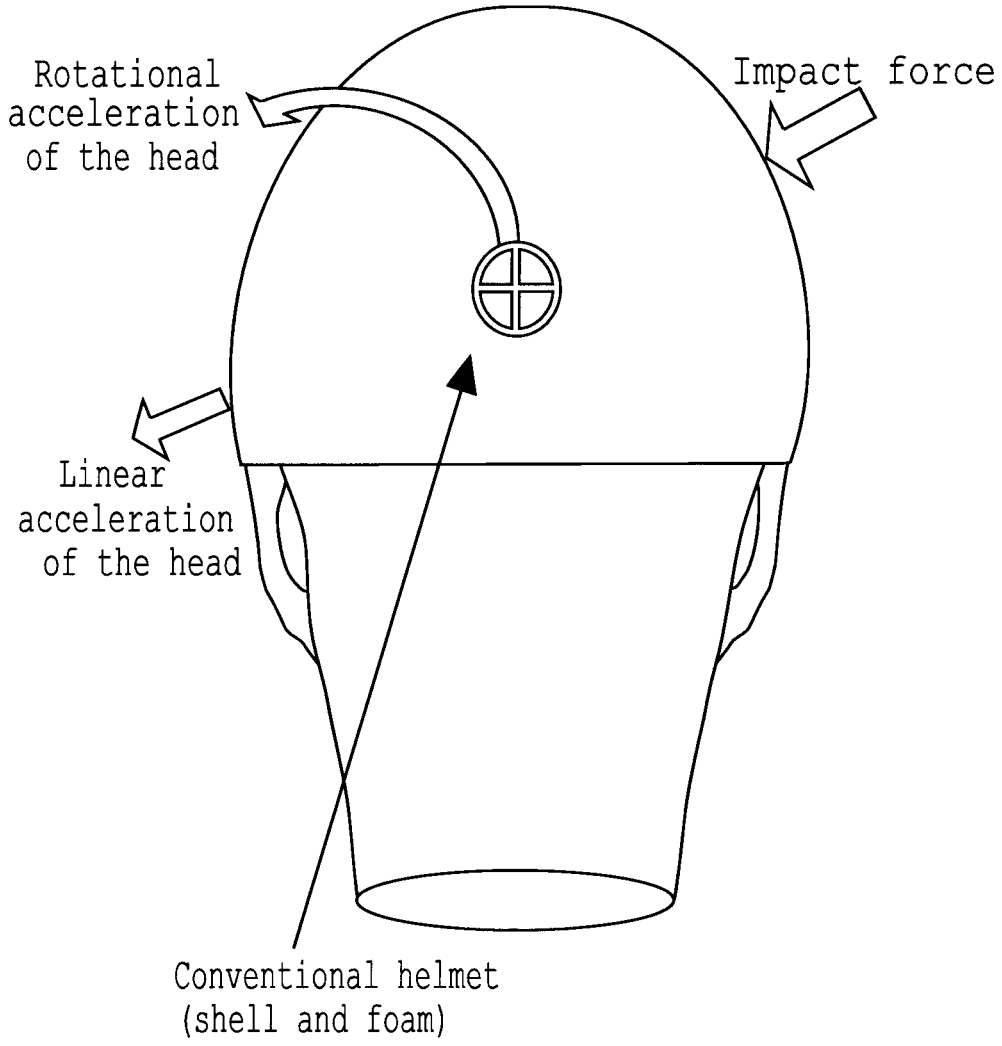
Prior Art Figure 3a
FIG. 3*a* is a rear elevation view of a human head wearing a conventional (prior art) helmet, showing the linear and rotational movement experienced by the head when a force impacts an outer shell of a conventional helmet worn over the head.
Figure 3B:
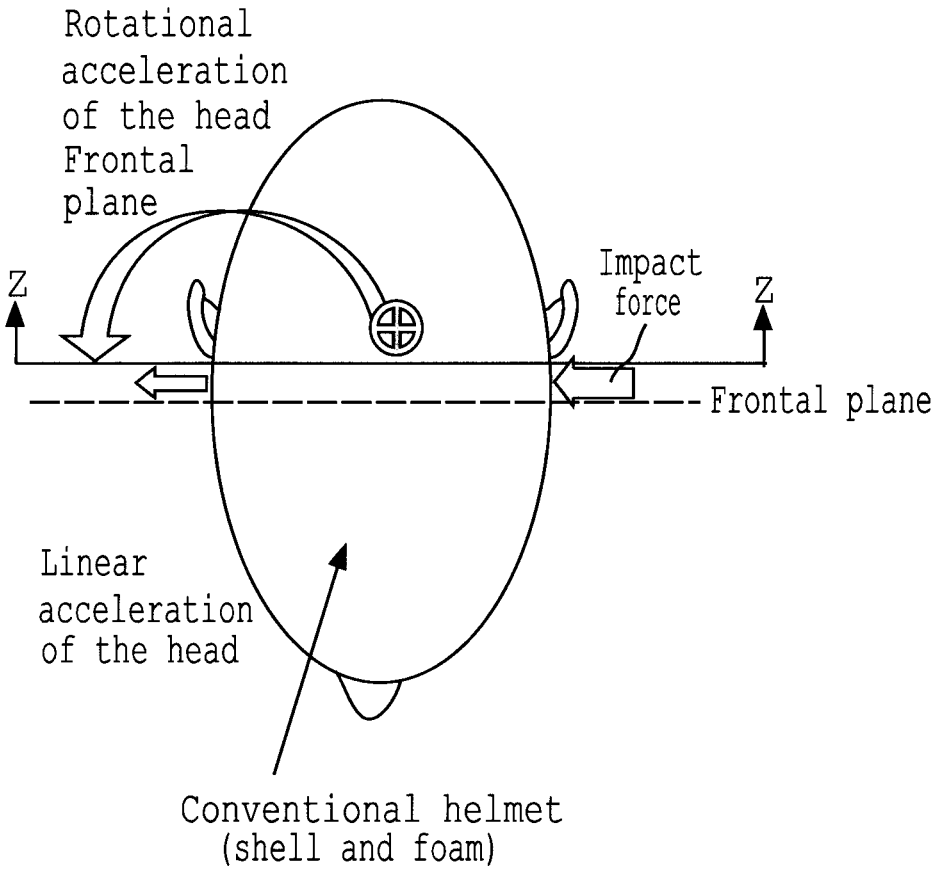
Prior Art Figure 3b
FIG. 3*b* is a top plan view of the head and helmet in FIG. 3*a* showing the linear and rotational movement experienced by the head.
Figure 3C:
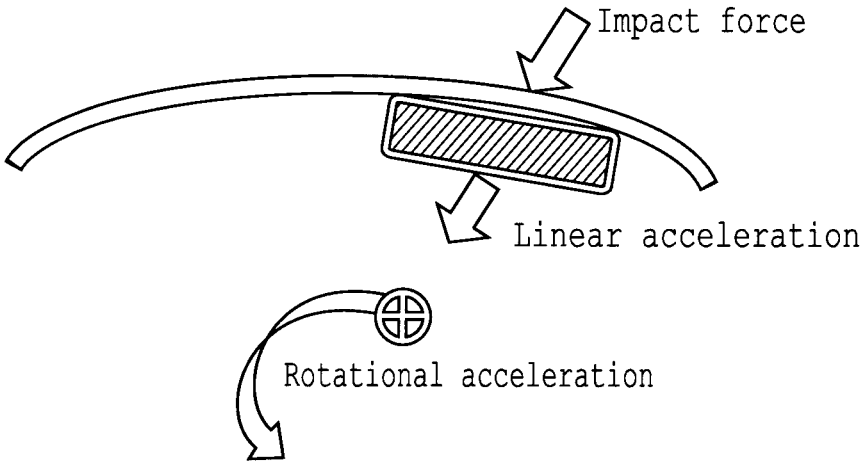
Prior Art Figure 3c
FIG. 3*c* is a partial cross sectional view of a portion of the helmet along line Z-Z in FIG. 3*b;*

Force redirection member 300 is configured to redirect a force of an impact that strikes outer shell 102, whereby the resultant movement of head 10 is in a different direction relative to the movement of shell 102. In one aspect, member 300 is configured to redirect the impacting force in a unidirectional fashion, so as to redirect rotational forces in a manner that may reduce the risk of certain injuries. Shown in FIGS. 5*a* and 5*b*, for illustration purposes only, the impact force has a magnitude and a direction corresponding to the force shown in FIGS. 3*a-c*. In this example, the force impacts the helmet 100 at a direction which is essentially perpendicular to the tangent of the surface of shell 102 at the point of impact. The force impacting shell 102 results in a linear acceleration of the head in the direction of the impact force, which in this case, is along the frontal plane (Fr). The head can also experience rotational acceleration caused by the head rotating about the spine about an axis of rotation that is displaced from the point of impact. Member 300 redirects the impact force whereby the resultant direction includes a component that is parallel to the horizontal plane (Hz) and a second component that is parallel to the frontal plane (Fr) of the head.

Member 300 is shown schematically in FIGS. 6*a*, 6*b*, 7*a* and 7*b*. Member 300 is wedge-shaped, having a flat base 301, an opposing sloping incident surface 304, a thin edge 305 and an opposing thick edge 307. Incident surface 304 faces outwardly towards shell 102 while base 301 faces liner 104. Base 301 is secured to the interior surface of bladder 202 and incident surface 304 is unsecured to the interior surface of bladder 202. This permits freedom of movement between member 300 and the upper surface of bladder 202. An incoming force (F) arriving from the direction D1 (also labelled as "Impact force") shown in FIGS. 5*b* and 6*a* forms an acute angle with surface 304. As a result, when spacer 200 is compressed by a force arriving from direction D1, member 300 is urged laterally in direction V2. This urges the connected lower surface 203 of bladder 202 towards direction V2, which in turn urges liner 104 in this same direction. The resulting force impacting the wearer's head is translated into perpendicular directional vectors V1 (corresponding to original direction D1) and V2. When thus redirected, the risk of certain injuries may be reduced if the position where member 300 is mounted in helmet 100 is selected appropriately as will be explained below. In this manner, the incoming force (F) is redirected such that the overall resultant force will have a have different direction (D2) than the incoming force (D1) to reduce the risk of an injury associated with acceleration of the head in the direction of the incoming force. Furthermore, the magnitude of the force in direction D1 is reduced by the decomposition of the force into vectors V1 and V2.

In other embodiments, member 300 can be configured so that the incoming force D1 is redirected and the overall resultant force D2 comprises two additional orthogonal vector components (i.e. V1, V2, and V3).

Force redirection member 300 can comprise various embodiments that provide the function whereby pressure exerted on the upper surface (i.e. the incident surface or the surface which faces outwards and in the direction of impact) thereof is converted into lateral movement that can urge the liner to rotate relative to shell 102. For example, member 300 may comprise a monolithic wedge-shaped member. The selection of material can depend on the intended activity and corresponding type of helmet. For example, member 300 may be made from a resilient material so that when an applied force is removed, member 300 can return to its original shape prior to the application of force, such as EPP, EPS or other closed cell foams such as evazote, vinyl nitrile foam, or a cross-linked foam.

Alternatively, member 300 may be made from a compressible material that tends to break or shatter if the applied force exceeds the level of compressibility of the material, such as EPS. For activities such as hockey or football, multiple impact materials may be preferred. For activities such as cycling, single impact materials may be preferred.

Member 300 can comprise a composite structure fabricated from multiple materials, having differing properties, in a layered or other structure, such as different levels of stiffness, resiliency and/or compressibility.

Alternative configurations of member 300 are also contemplated, wherein at least a portion of the upper face thereof is sloping relative to the lower face. Examples include shapes such as cylindrical or disk-like, a truncated cylinder, a truncated right circular cone, a spherical wedge, a prism, a conoid (section of a wedge), a section of a truncated cylinder, a section of a truncated right circular cone, a section of a spherical wedge, a section of a prism, or a section of a conoid. Alternatively, member 300 can comprise parallel upper and lower faces, but provide an internal structure that achieves a wedge-like function, for example a relatively rigid internal wedge, covered by a soft layer that has an upper surface parallel to the lower surface of member 300.

Member 300 can be asymmetrical in shape. Alternatively, member 300 can be symmetrical about one plane of symmetry or multiple planes of symmetry.

In one embodiment, force redirection member 300 unsecured to the wall of bladder 202 and is freely moveable within the bladder. Compression of spacer 200 in this embodiment displaces member 300 within bladder 202.

Figure 6A:
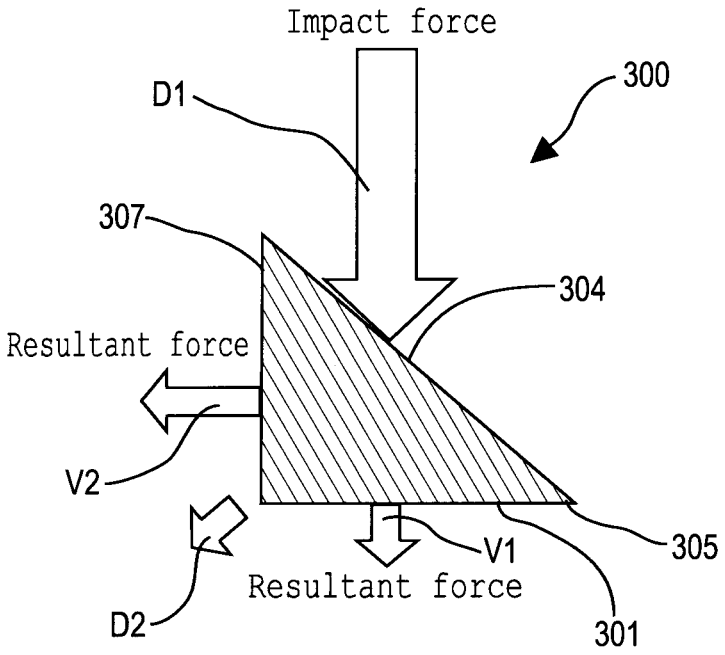
FIG. 6*a* is a schematic side elevation view of a force redirection member according to one embodiment of the present invention.
Figure 6B:
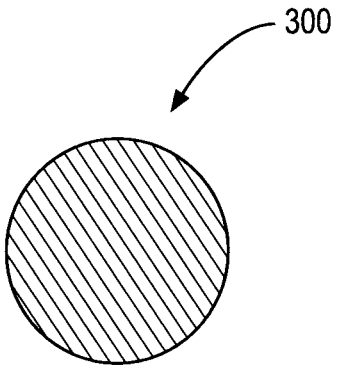
FIG. 6*b* is a schematic top plan view of the force redirection member shown in FIG. 6*a*.
Figure 7A:
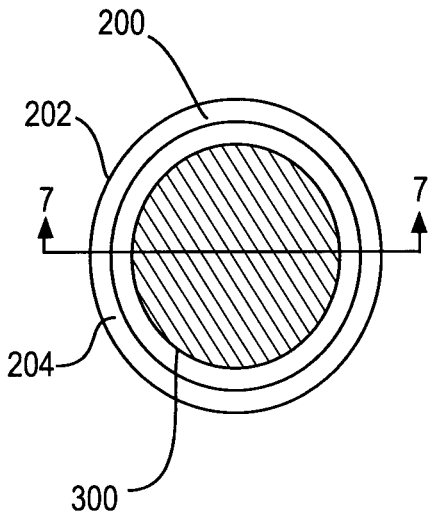
FIG. 7*a* is a top plan view of a second embodiment, providing an alternative force redirection member.
Figure 7B:
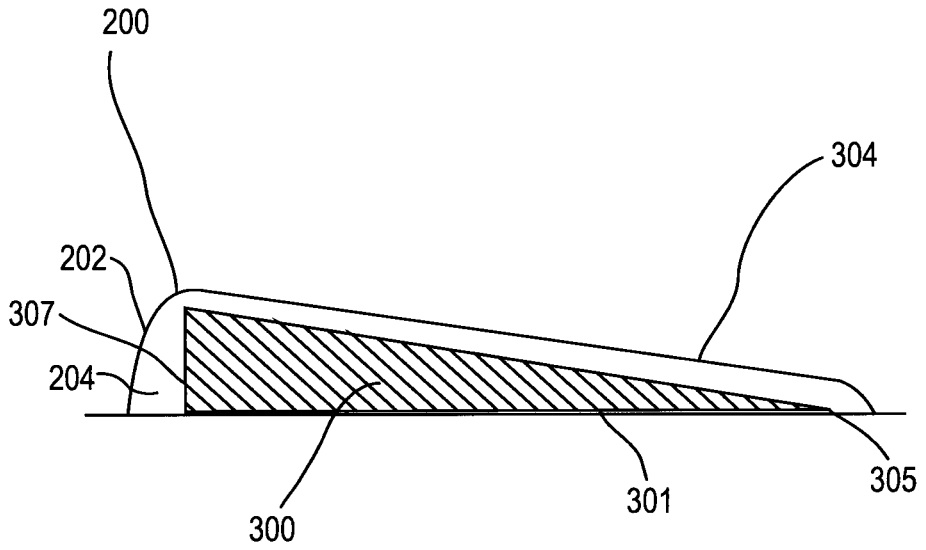
FIG. 7*b* is a cross-sectional view along line 7-7 of FIG. 7*a;*

In some other embodiments, such as depicted in FIGS. 6*a* and 6*b*, the spacer comprises only force redirection member 300, which is not contained within a bladder.

Figure 8A:
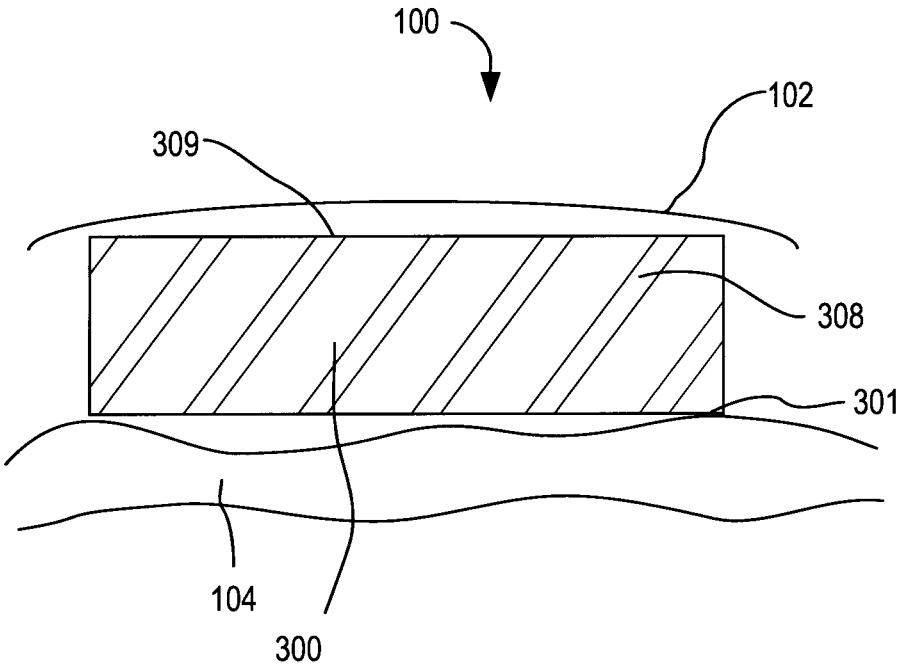
FIG. 8*a* is a side elevation view of another embodiment of the force redirection member according to the present invention before impact with a force.
Figure 8B:
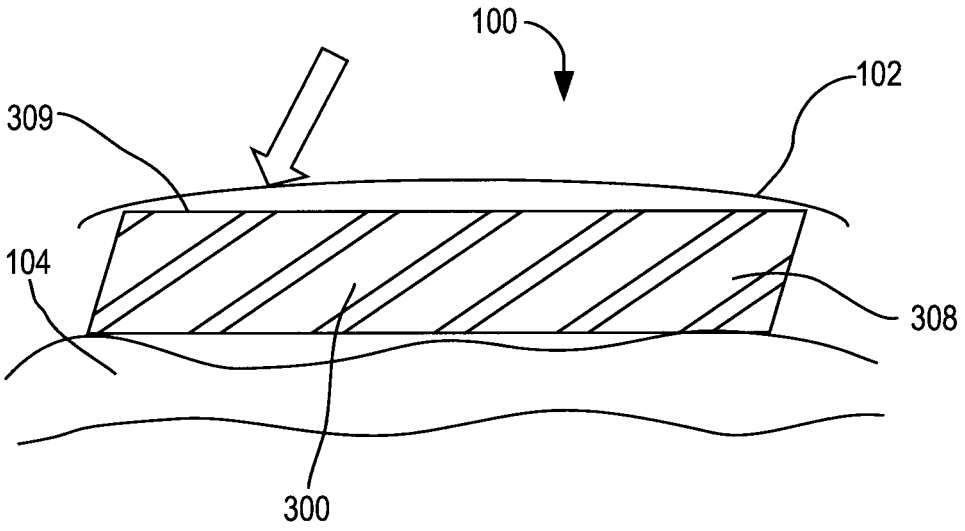
FIG. 8*b* is a side elevation view of another embodiment of the force redirection member according to the present invention after impact with a force.

FIGS. 8*a* and 8*b* illustrate an embodiment wherein member 300 comprises a plurality of internal ribs 308. Ribs 308 are semi-rigid structures and are angled with respect to an outer surface 309 and the base 301 of member 300 and together form a series of parallelograms. Upon impact of outer shell 102 with a force (f), member 300 will compress. As a consequence of the compression of member 300, the resultant force (f) will now be redirected into a direction that is different than the direction of the incoming force. The direction of the resultant force will be dictated in part, by the angle of ribs 308 formed with outer surface 309 and base of member 300.

Figure 9A:
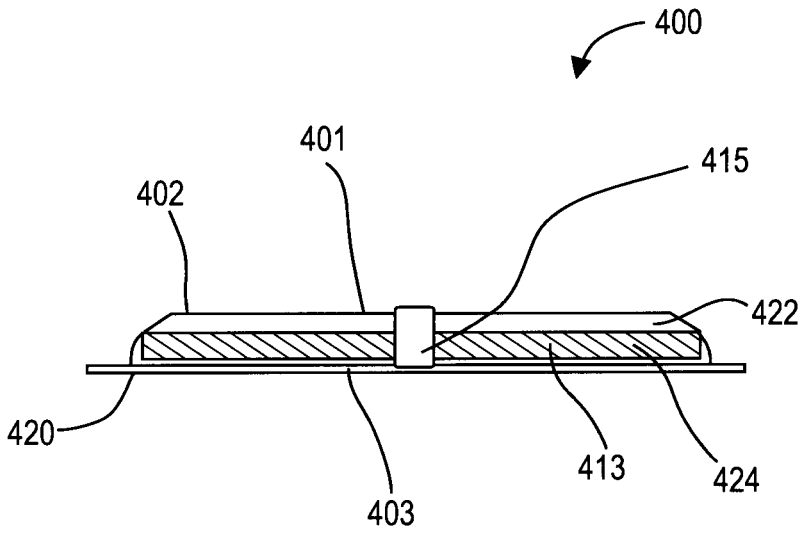
FIG. 9*a* is a side elevation view of another embodiment of the force redirection member and a belt secured within a spacer according to the present invention.
Figure 9B:
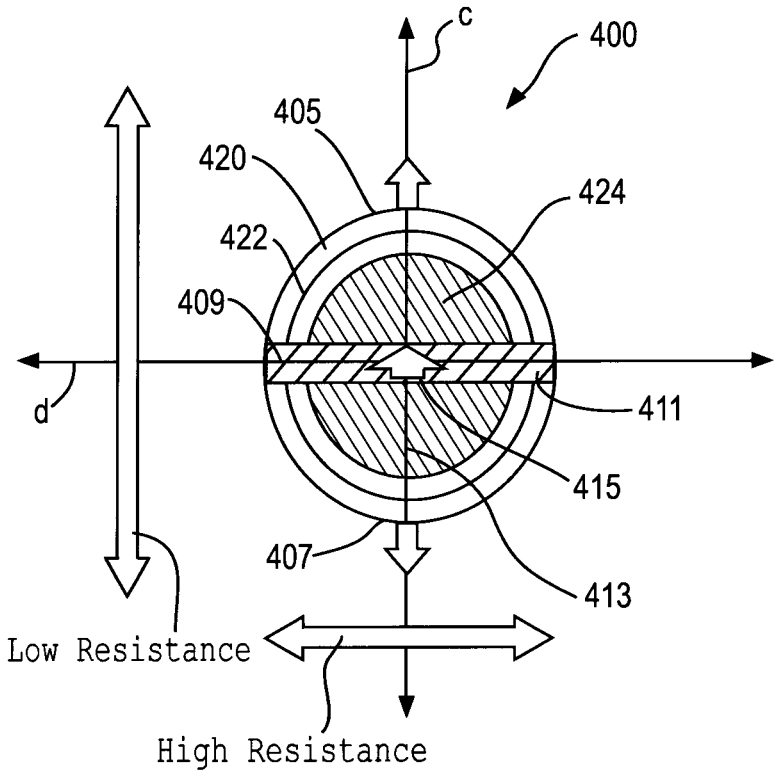
FIG. 9*b* is a top plan view of the force redirection member shown in FIG. 9*a*.

FIGS. 9*a* and 9*b* illustrate an embodiment wherein spacers 400 are configured to control shear acting between shell 102 and liner 104 (not shown in these drawings). Spacers 400 are secured by adhesive or other non-slip attachment to shell 102 and liner 104 respectively. Spacers 400 may be disk-shaped, defined by upper and lower surfaces 401 and 403, front and rear end portions 405 and 407 and lateral side portions 409 and 411. A longitudinal axis "c" extends between ends 405 and 407. A lateral axis "d" extends between sides 409 and 411. Each spacer 400 comprises a body 413, partially or wholly encircled with a relatively rigid belt 415 extending between lateral edges 409 and 411. Belt 415 may comprise a polyester band integral or secured to spacer 400. Spacer 400 may comprise a body that is resilient to permit lateral movement of liner 104 relative to shell 102 in response to shear forces acting between these components. In the present embodiment, spacer 400 comprises a bladder 420, filled with a liquid 422. Optionally, a rigid or resilient disk 424 is provided within the interior of bladder 420 and may be secured or is unsecured to the interior surface of bladder 420.

Spacer 400 may be configured to restrict lateral movement between shell 102 and liner 104 along axis "d", while permitting movement between these components along axis "c". Belt 415 is sufficiently rigid to prevent internal "rolling" of spacer 400, or lateral (shearing) movement of the upper and lower surfaces 401 and 403 of spacer 400 relative to each other along axis d. In this fashion, lateral (shear) movement of liner 104 relative to shell 102 is restricted along axis d in response to shear forces experienced by shell 102 relative to liner 104, while movement of liner 104 relative to shell 102 is less restricted along axis c.

At least one shear control spacer 400 is provided between shell 102 and liner 104 at one or more selected positions. Spacer 400 allows shear forces acting on helmet 100 along axis c to be attenuated when transferred to liner 104, by permitting lateral displacement of liner 104 relative to shell 102 in response to shear forces acting on shell 102 in this direction. However, shear forces that act on shell 102 in axis d are directly transmitted to liner 104 with less attenuation. Strategic emplacement of spacers 400 provide helmet 100 with the ability to manage shear forces in a way that attenuates such forces acting within one or more planes that have a higher risk of causing concussion or other brain injury, while not attenuating shear forces along planes that do not tend to cause such injuries.

The ability to manage and redirect impact forces is desired to effectively redirect certain accelerations of head 10, based on the location and direction of the impact on helmet 100. The impact to helmet 100 causes forces (linear and/or rotational) to act on head 10 that reflect the interaction of head 10 and helmet 100. For instance, helmet 100 can be designed to decrease the risk of concussive injuries by managing the linear and rotational accelerations specific to the location on head 10 and the direction of the force that creates the highest risk of injury. Thus, it will be understood that spacers 200 and/or 400 can be configured to manage shear forces in one direction differently than in other directions.

Multiple spacers 200 and/or 400 are secured to the interior of the helmet 100. The locations of spacers 200 and/or 400 correspond to specific regions of the typical user's head 10 when the helmet is worn to redirect an incoming force in a direction that reduces the possibility of head injury occurring as a result of rotational acceleration of the head in specific directions.

Spacers 200 and/or 400 are mounted to helmet 100 in a configuration that redirects incoming forces (F) coming from direction D1, to reduce the rotational acceleration of the head in a first direction likely to cause head injury, towards a second direction less likely to cause such injury. As discussed above, forces that cause rotational acceleration of the head in the direction defined by the sagittal plane (i.e. rotation of the head about axis T) are risk factors for subdural haematoma injuries. This movement can be caused, for example, by an impact to the back of the helmet.

For example, in one embodiment for decreasing the risk of sub-dural haematoma, spacers 200 and/or 400 are distributed along a region substantially aligned with the sagittal plane of head 10 when the helmet 100 is worn, and in particular, in the front and rear of head 10. In this configuration, spacers 200 and/or 400 are positioned to redirect an incoming force of direction D1 that rotationally accelerates head 10 within the sagittal plane (i.e. rotation about axis T) into resultant force D2. Force D2 has a first directional vector parallel to the horizontal plane and a second directional vector that is parallel to the frontal plane of the head. Additionally, spacers 200 and/or 400 would be oriented in a position to suppress the incoming rotational forces directed along the sagittal plane. The result would attenuate and redirect rotational force and decrease the risk of sub-dural haematoma.

Figure 10A:
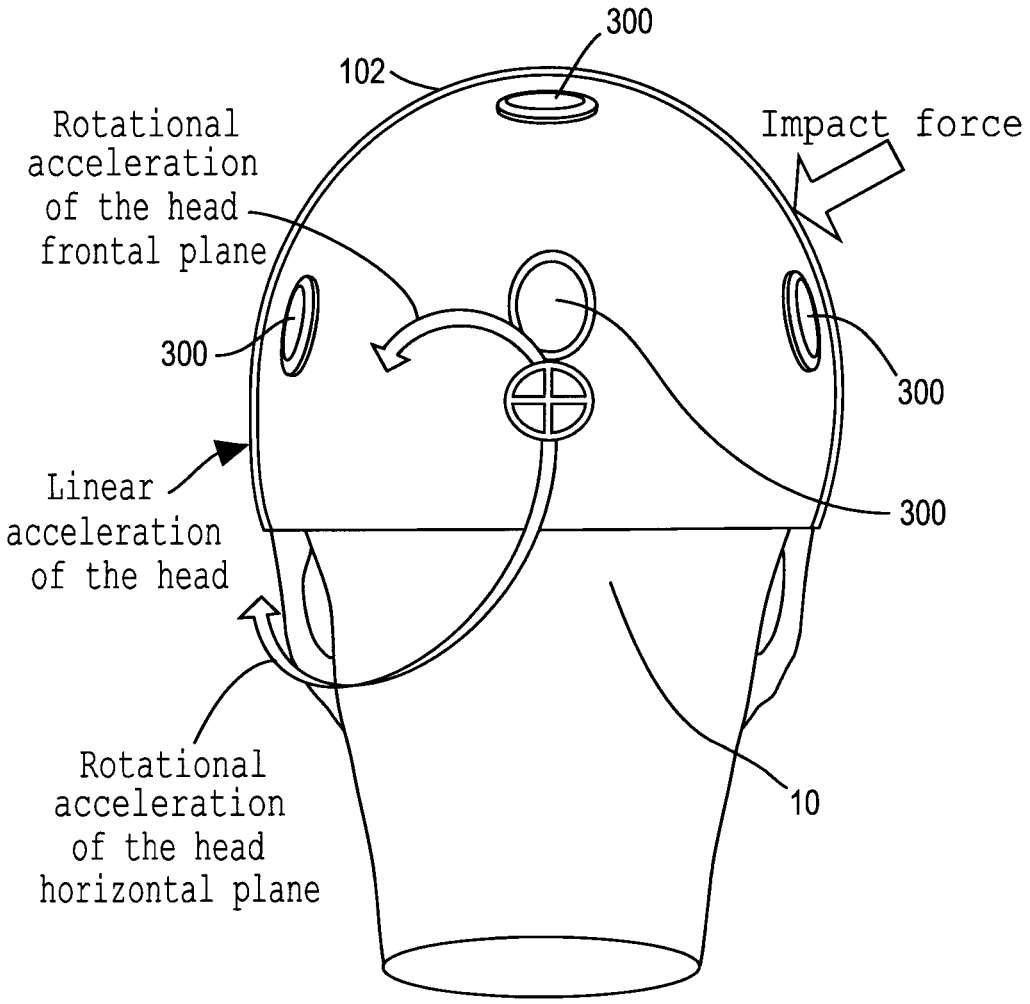
FIG. 10*a* is a rear elevation view of a human head wearing a helmet according to the invention, showing linear and rotational movement experienced by the head when a force impacts the helmet.
Figure 10B:
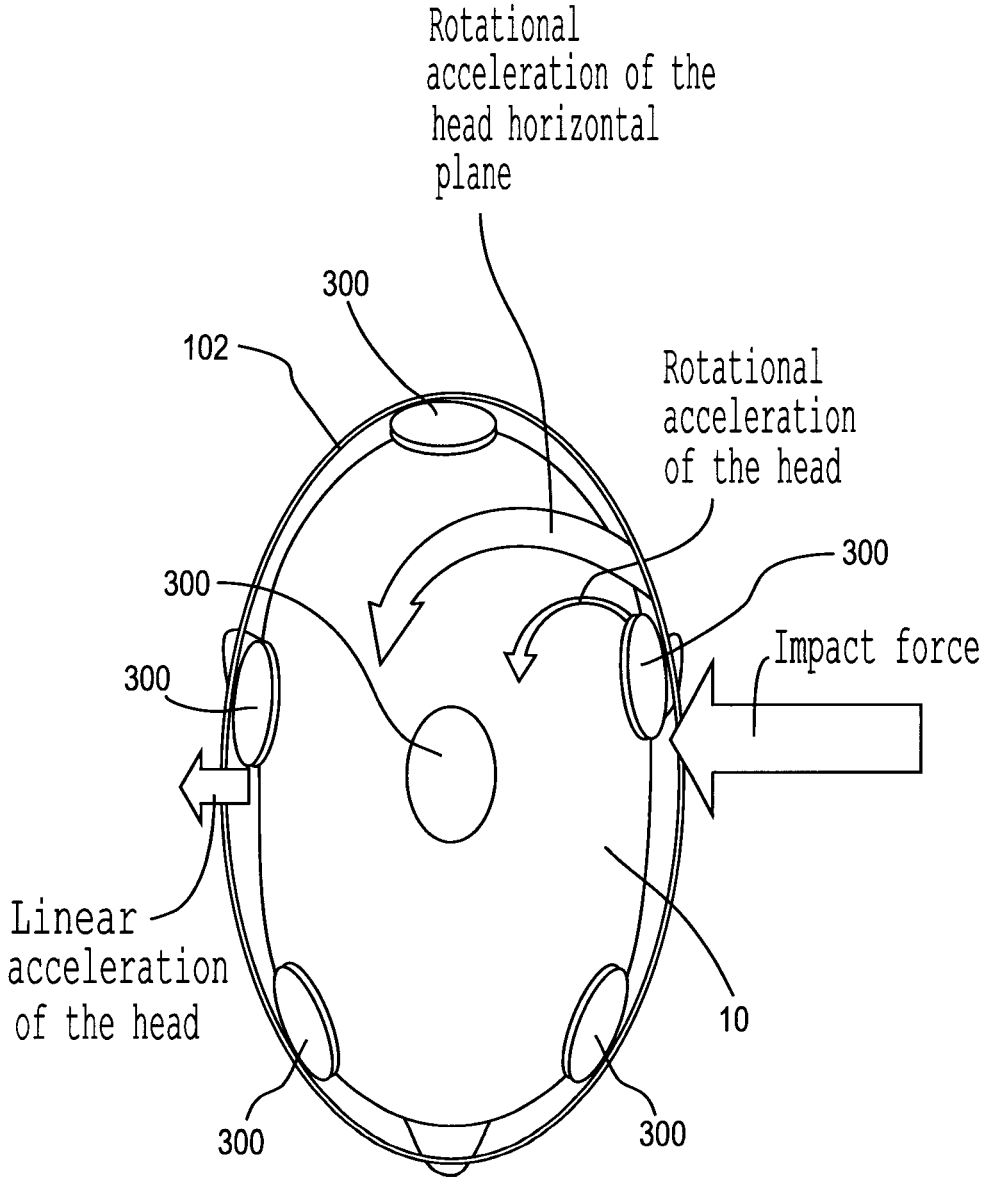
FIG. 10*b* is a top plan view of the head and helmet of FIG. 10*aa*, showing linear and rotational movement experienced by the head.

Forces that cause rotational acceleration of the head within the frontal plane (i.e. rotation of the head about axis L) present a risk factor for concussions. This movement can be caused, for example, by an impact to the lateral side of the helmet as shown in FIGS. 10*a*-10*b*. In one embodiment for decreasing the risk of concussion, spacers 200 and/or 400 may be mounted in a region substantially aligned with the frontal plane of head 10 when the helmet 100 is worn, and in particular, at the lateral sides of helmet 100. In this arrangement, spacers 200 and/or 400 are positioned to redirect incoming forces D1 that cause rotational acceleration of the head about axis L, into a resultant force D2. Force D2 comprises a first vector parallel to the horizontal plane of the head and a second vector parallel to the sagittal plane of the head. Additionally, spacers 200 and/or 400 can be distributed so as to attenuate forces causing the head to rotate within the frontal plane. The result would be an attenuation and redirection of rotational force and a decrease the risk of concussion.

Figure 11:
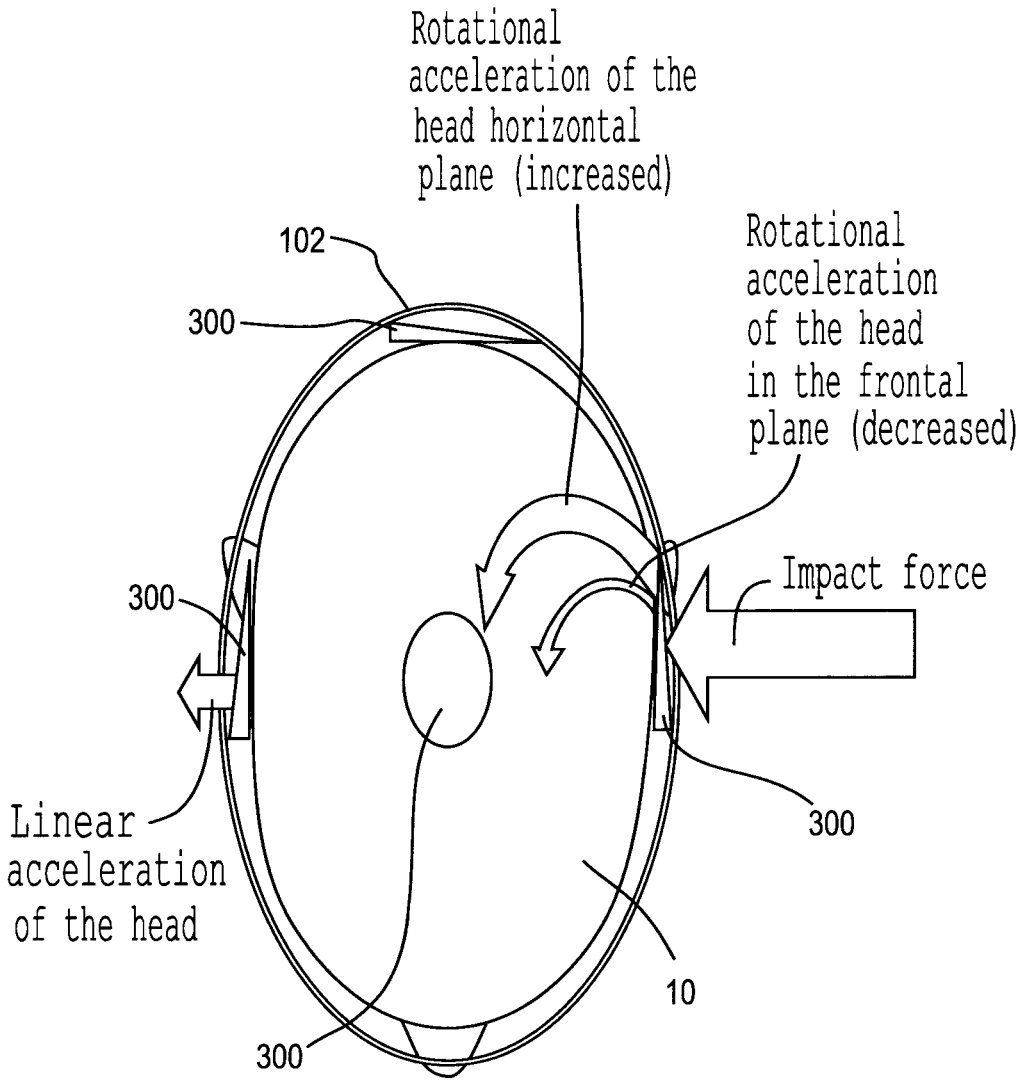
FIG. 11 is a top plan view of a head showing the linear and rotational movement experienced by the head when a force impacts the helmet comprising a plurality of wedge-shaped force redirection members according to another embodiment of the present invention.
Figure 12A:
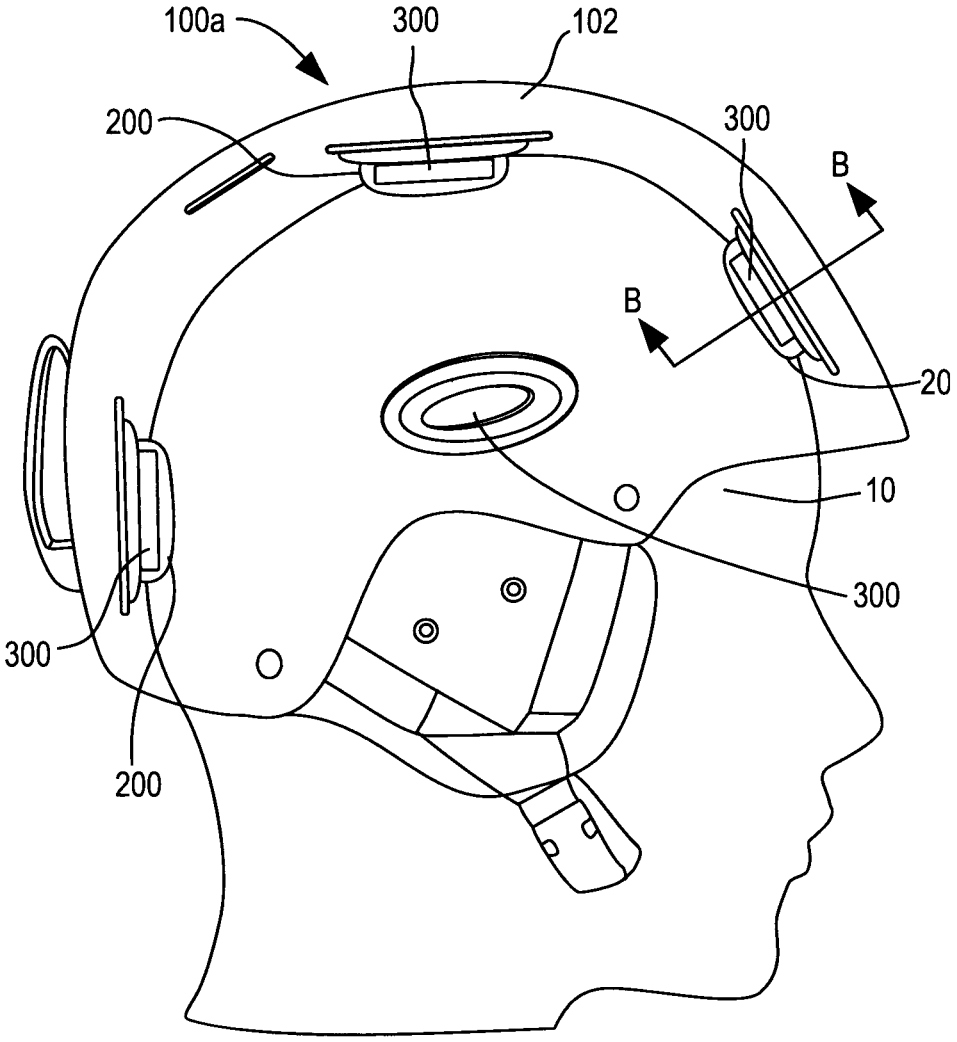
FIG. 12*a* is a side elevation view of the helmet, in partial transparency to show internal structure.
Figure 12B:
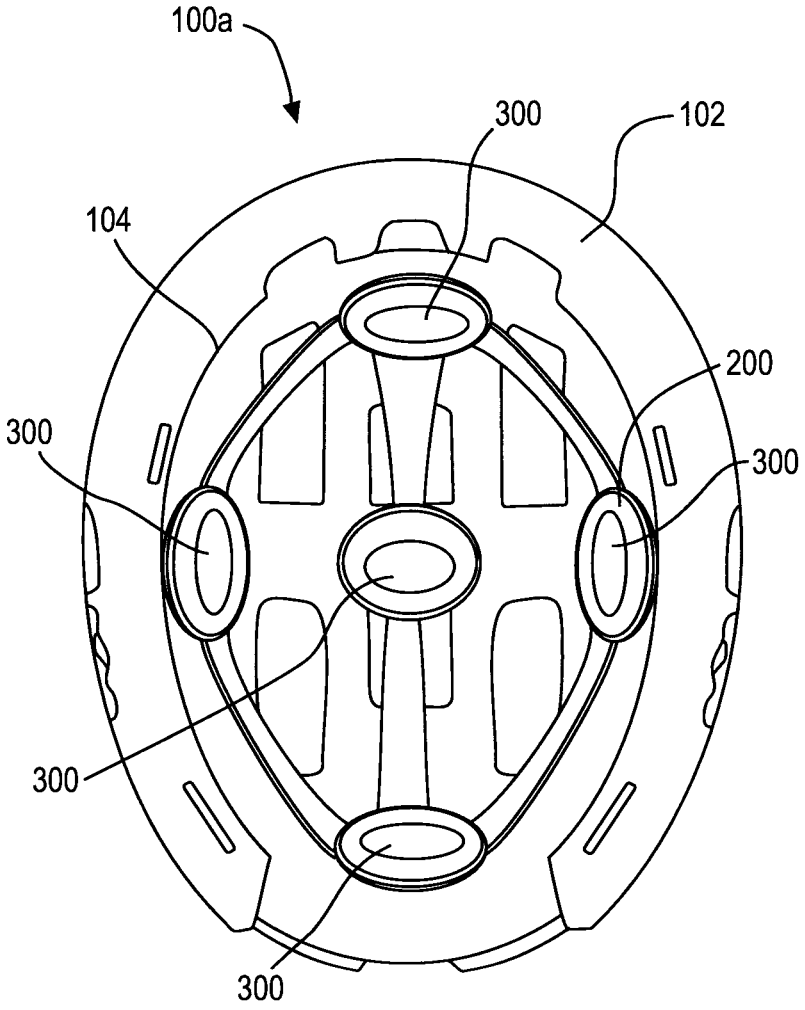
FIG. 12*b* is a bottom plan view of the helmet shown in FIG. 12*a;*

In another embodiment as shown in FIG. 11, a plurality of spacers 200 each comprising a wedge-shaped member 300 and which can be mounted in a region of helmet 100 substantially aligned with the frontal plane of head 10 when helmet 100 is worn, and in particular, at the sides of helmet 100. In this orientation, incoming forces (labelled "impact force" and having a direction D1) that will tend to cause rotational acceleration of the head along the frontal plane (i.e. rotation of the head about axis L) will now be redirected by spacers 200 so that the resultant force (having a different direction D2) now comprises a directional vector component that is parallel to the horizontal plane and a directional vector component that is parallel to the frontal plane. Furthermore, as a consequence of the redirection of force by spacers 200, the magnitude of the force component that is parallel to the frontal plane is reduced—the result being decreased rotational acceleration along the frontal plane (i.e. rotation of the head about the axis L).

Figure 13A:
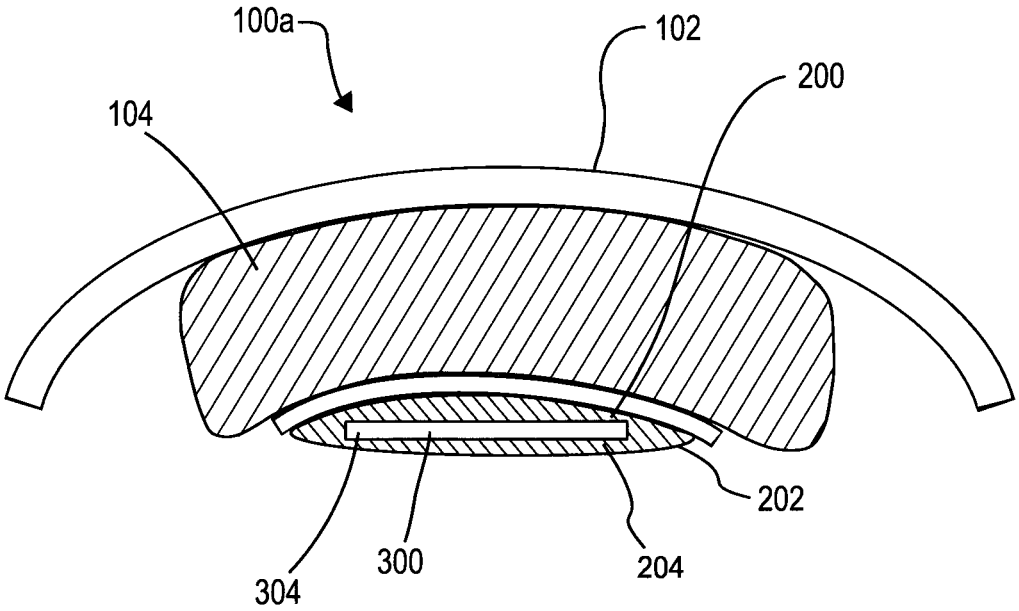
FIG. 13*a* is a cross sectional view along the line B-B in the helmet of FIG. 12*a* showing the force redirection member before impact with a force.
Figure 13B:
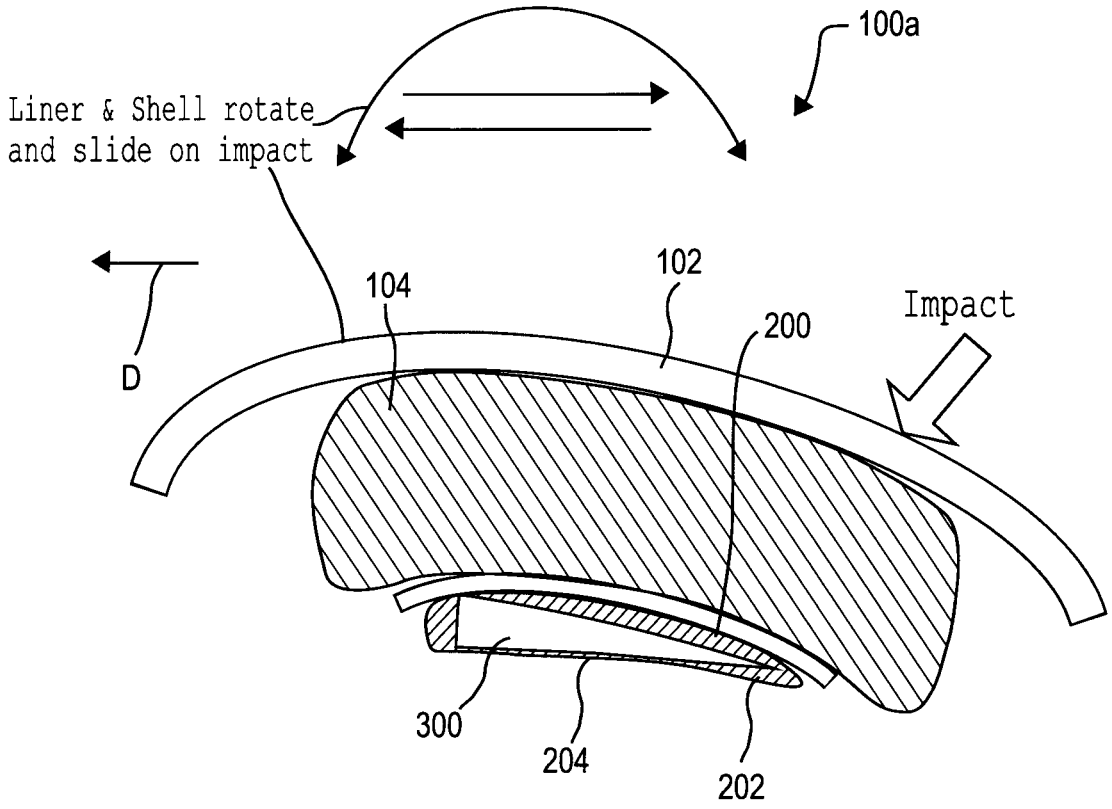
FIG. 13*b* is a cross sectional view of the portion of the helmet along the line B-B in the helmet of FIG. 12*a* showing the force redirection member after impact with a force.

FIGS. 12*a* through 13*b* illustrate an embodiment of helmet 100*a* wherein spacer 200 directly contacts the user's head 10 when the helmet is worn. As shown in FIG. 13*b*, upon impact, outer shell 102 and inner layer 104 rotate and/or slide together and the forces transmitted through outer shell 102 are redirected by force redirection member 300, in a manner similar to the embodiment shown in FIGS. 5*a* and 5*b*.

Spacer 200 can be made to have various dimensions and shapes to provide specific properties. As non-limiting examples, spacer 200 has a width at its base of about 48 mm to 54 mm and a height of about 4 mm, or a base width of about 63.5 mm to 66.5 mm and a height of about 4 mm.

The embodiments of the present application described above are intended to be examples only. Those of skill in the art may effect alterations, modifications and variations to the particular embodiments without departing from the intended scope of the present application. In particular, features from one or more of the above-described embodiments may be selected to create alternate embodiments comprised of a sub combination of features which may not be explicitly described above. In addition, features from one or more of the above-described embodiments may be selected and combined to create alternate embodiments comprised of a combination of features which may not be explicitly described above. Features suitable for such combinations and sub combinations would be readily apparent to persons skilled in the art upon review of the present application as a whole. Any dimensions provided in the drawings are provided for illustrative purposes only and are not intended to be limiting on the scope of the invention. The subject matter described herein and in the recited claims intends to cover and embrace all suitable changes in technology.

The invention claimed is:

1. A helmet comprising:

a shell; and at least one force redirection member disposed between the shell and a head when the helmet is worn, the member configured to redirect a force impacting on the shell to a direction different from the original direction of the impact on the shell, wherein the at least one force redirection member further comprises a wedge-shaped body having a base and an opposing incident surface disposed at an acute angle relative to a tangent of a surface of the helmet overlying the at least one force redirection member, whereby the force impacting on the shell is exerted on the incident surface to thereby redirect said force;

wherein the body comprises a composite structure of a first material and a second material different from the first material.

2. The helmet of claim 1, wherein the at least one force redirection member is symmetrical about two orthogonal planes of symmetry.

3. The helmet of claim 1, comprising a plurality of the force redirection members distributed at a plurality of locations around the helmet.

4. The helmet of claim 3, wherein the plurality of the force redirection members are distributed along a region of the helmet that is aligned with a sagittal plane of the head when the helmet is worn.

5. The helmet of claim 4, wherein the force redirection members redirect the force so that the different direction is composed of a first directional vector component that is parallel to a horizontal plane and a second directional vector component that is parallel to a frontal plane of the head when the helmet is worn.

6. The helmet of claim 3, wherein the plurality of force redirection members are distributed along a region of the helmet that is aligned with a frontal plane of the head when the helmet is worn.

7. The helmet of claim 6, wherein the force redirection members redirect the force so that the different direction is composed of a first directional vector component that is parallel to a horizontal plane and a second directional component that is parallel to a sagittal plane of the head when the helmet is worn.

8. The helmet of claim 1, wherein the at least one force redirection member is disposed between the shell and a helmet liner.

9. The helmet of claim 1, wherein the at least one force redirection member is retained within a fluid-filled bladder.

10. The helmet of claim 1, wherein the at least one force redirection member comprises a compressible member that provides a fulcrum between the shell and the user's head, whereby an impact on the shell rotates the shell relative to the head about the fulcrum whilst compressing at least a portion of the force redirection member for attenuating the rotational force of the shell.

11. The helmet of claim 1, further comprising a shear control spacer, the shear control spacer configured to resist compression of the spacer along at least one portion of the shear control spacer.

12. A method to decrease the risk of injury to a head of a person wearing a helmet, caused by a rotational force during an impact to the helmet by a force characterized by a specific direction having a first vector, the method comprising:

securing a wedge-shaped force redirection member to an interior of the helmet, the member having a base and an opposing incident surface disposed at an acute angle relative to a tangent of a surface of the helmet overlying the at least one force redirection member, wherein the force redirection member comprises a composite structure of a first material and a second material different from the first material and is configured to receive the force impacting the helmet so that pressure is exerted on the incident surface based on the force impacting the helmet; and redirecting the rotational force into a predetermined different direction having a second vector by positioning the force redirection member so that the force will meet the incident surface to form an angle therewith that is different from an angle normal to the incident surface to change the directional vector of the force so that the second vector comprises at least one vector component that is different from that of the first vector, wherein the redirecting to the second vector reduces the risk of a specified injury associated with acceleration of the head in the direction of the first vector.

13. The method of claim 12, wherein the force redirection member is secured along a region of the interior of the helmet that is aligned with a sagittal plane of the head of the person wearing the helmet and wherein the at least one vector component is parallel to a horizontal plane.

14. The method of claim 13, wherein the force redirection member is secured along a region of the interior of the helmet that is aligned with a frontal plane of the head of the person wearing the helmet and wherein the at least one vector component is parallel to a horizontal plane.

15. The method of claim 12, wherein the force redirection member is secured along a region of the interior of the helmet that is aligned with a frontal plane of the head of the person wearing the helmet and wherein the at least one vector component is parallel to a horizontal plane.

16. A helmet comprising:

a shell; and one or more fluid-filled bladders;

wherein each bladder includes a wedge-shaped force redirection member retained therein, wherein each force redirection member comprises a base and an opposing sloping surface that forms an acute angle relative to a tangent of a surface of the shell overlying the respective force redirection member, and wherein the acute angle of said opposed sloping surface of each force redirection member is configured to redirect a force impacting on the shell to a direction different from an original direction of the impact on the shell.

* * * * *